United States Patent [19]

Boyer

[11] 4,332,671

[45] Jun. 1, 1982

[54] PROCESSING OF HEAVY HIGH-SULFUR CRUDE OIL

[75] Inventor: Lyndon D. Boyer, Ponca City, Okla.

[73] Assignee: Conoco Inc., Ponca City, Okla.

[21] Appl. No.: 271,448

[22] Filed: Jul. 8, 1981

[51] Int. Cl.[3] ..... C10G 53/16; C10G 55/08; C10G 57/00

[52] U.S. Cl. ..... 208/92; 208/80; 208/93; 208/131

[58] Field of Search ..... 208/92, 93, 131, 80

[56] References Cited

U.S. PATENT DOCUMENTS 3,702,292 11/1972 Burich ..... 208/93

3,723,291 3/1973 Thakker ..... 208/131

4,075,084 2/1978 Skripek et al. ..... 208/92

*Primary Examiner*—Delbert E. Gantz

*Assistant Examiner*—G. Caldarola

*Attorney, Agent, or Firm*—Richard W. Collins

[57] ABSTRACT

Heavy high-sulfur crude oil is subjected to distillation to produce gas and liquid hydrocarbon products and a residuum. The gas and liquid products are desulfurized. Part of the residuum is coked in a delayed coker, and sulfur in the coke is removed by high temperature calcination. The remainder of the residuum is air-blown to produce an asphalt product, and sulfur recovered from the other products is added to the asphalt to produce a sulfur-enriched asphalt product.

6 Claims, 1 Drawing Figure

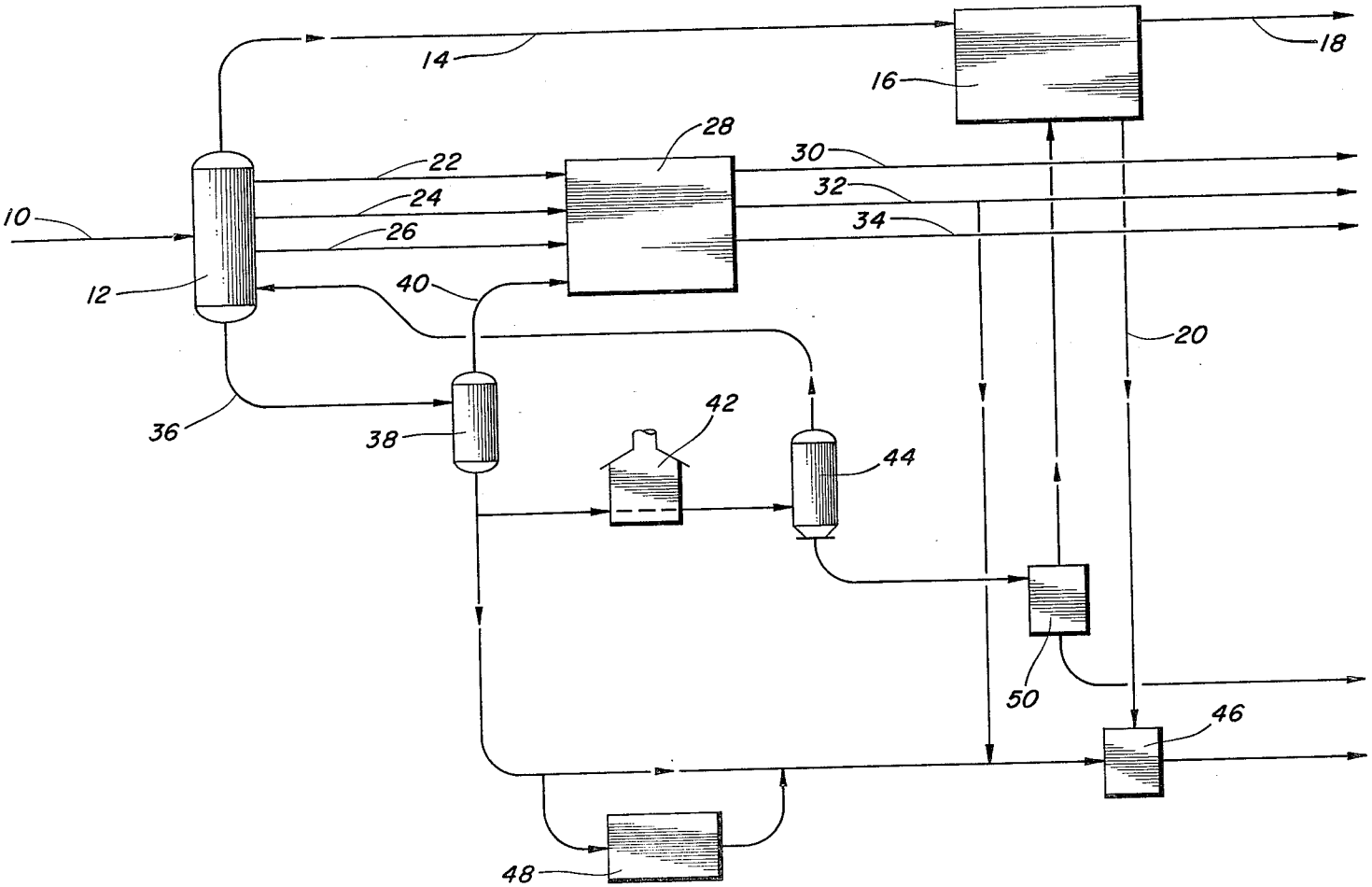
10
12
14
16
18
20
22
24
26
28
30
32
34
36
38
40
42
44
46
48
50

PROCESSING OF HEAVY HIGH-SULFUR CRUDE OIL

BACKGROUND OF THE INVENTION

This invention relates to processing of heavy high-sulfur crude oils, and more particularly to processing of such crude oils which have properties making them difficult or impossible to process using conventional petroleum refining techniques.

It is generally accepted that the free world's available supply of high-gravity low-sulfur crude oil is becoming exhausted. Of necessity, less desirable crude oils, particularly high-sulfur crude oils, must be utilized to supply the products needed to provide energy for transportation, power and heating. Many existing refineries do not have the capability of processing high-sulfur crude oils.

Several processes have been suggested for handling low-gravity crude oils having a high sulfur content. Most of these processes include a desulfurization step and coking of at least a part of the material. However, in order to be usable, the coke product must have a relatively low sulfur content, such as from 0.5 to 1.5 percent by weight sulfur. Since some crude oils now being considered contain from four to as high as ten percent or more by weight sulfur, and since most products from such crude oils, in order to be environmentally and commercially acceptable, must contain much less sulfur than the crude oil feedstocks, it is apparent that a considerable amount of sulfur must be removed and disposed of when such high-sulfur crude oils are processed.

As an example, a single refinery processing 100,000 barrels per day of 9.5 weight percent sulfur crude oil would produce an amount of by-product sulfur equal to about five percent of the current domestic market. It is apparent that, in order for a significant amount of high-sulfur crude oil to be processed, some provision must be made for disposal of the huge quantities of by-product sulfur.

It has been proposed to utilize sulfur as a partial replacement for bitumen in asphalt road paving. This would provide an outlet for huge amounts of sulfur, such that processing of high-sulfur crude oil would not totally disrupt the sulfur market. A discussion of the sulfur paving process appears in the Aug. 11, 1976 issue of *Chemical Week* at page 20.

SUMMARY OF THE INVENTION

According to the present invention, a process for producing useful products from low-gravity high-sulfur crude oil is provided. The process involves subjecting the crude oil to distillation to produce gas and liquid products and a residuum. The gas and liquid products are subjected to sulfur removal to produce low-sulfur products.

A part of the residuum is subjected to delayed coking, and the coke is desulfurized by high temperature calcination to produce a low-sulfur coke suitable for use as anode coke in the aluminum industry or as metallurgical coke for blast furnaces.

The remainder of the residuum is air blown to produce an asphalt. The asphalt may be cut back with a distillate material from the initial distillation to meet product specifications, and sulfur recovered from the distilled products and the calcined coke is added to the asphalt to provide a sulfur-enriched asphalt.

It is an object of the present invention to provide a process for producing valuable products from heavy high-sulfur crude oils.

It is a further object to provide such a process which provides a useful outlet for by-product sulfur produced from processing high-sulfur crude oils.

The foregoing as well as additional objects and advantages are obtained by the present invention, as will be apparent from the following detailed description of the preferred embodiments thereof.

DESCRIPTION OF THE DRAWING

The FIGURE is a schematic representation of a preferred embodiment of the process of the invention.

DESCRIPTION OF THE PREFERRED EMBODIMENT

The process of the invention will first be described generally, with reference to the FIGURE.

Feedstocks suitable for the process are high-sulfur crude oils containing at least two percent by weight sulfur. Typically, feedstocks having from four to twelve percent by weight sulfur would be utilized. Feedstocks having a fairly wide range of API gravity can be used, but preferably crudes having an API gravity below about 20 are used. Very heavy crudes having a sulfur content about five percent by weight and an API gravity of from −5 to +5 are particularly appropriate for this invention.

As shown in the FIGURE, feedstock from line 10 is fed to an atmospheric pressure crude oil distillation unit 12 where it is separated into gases, liquid products and an atmospheric residuum. Gases from atmospheric distillation unit 12 are removed through line 14 and passed to a gas scrubber and sulfur plant 16. The gas scrubber and sulfur plant may be of conventional design, producing a relatively sulfur-free gas stream which is recovered through line 18 and a sulfur product which is removed through line 20. Naphtha, distillate and gas oil products from atmospheric distillation unit 12 are drawn off through lines 22, 24 and 26 respectively and fed to desulfurization unit 28 where the sulfur content of the liquid products is reduced by conventional hydrotreatment, yielding low-sulfur naphtha, distillate and gas oil through lines 30, 32 and 34 respectively. These desulfurized products may be utilized separately or combined to make a wide boiling range low-sulfur syncrude.

The residuum from atmospheric distillation unit 12 passes through line 36 to vacuum distillation unit 38 where it is vacuum-distilled to produce a vaporized gas oil product through line 40 which is also desulfurized to provide a low-sulfur gas oil product which may be recovered separately or combined with the gas oil from the atmospheric unit. A vacuum residuum from vacuum unit 38 is split, part of it going to coker furnace 42 where it is heated and then delayed-coked in coker 44, and the remainder going to asphalt blender 46. The portion of vacuum residuum going to asphalt blender 46 normally is air blown in vessel 48 according to conventional asphalt producing techniques to produce asphalt having particular properties. The vacuum residuum or asphalt may be cut with a portion of the distillate from atmospheric unit 12 for viscosity adjustment.

Overhead vapors from coker 44 are recycled to atmospheric unit 12, and delayed coke product having a high sulfur content is heated at high temperature, such as from 1450° to 1600° C., in calciner 50 to desulfurize and calcine the coke. Sulfur-containing gases, primarily $H_2S$, are treated in gas scrubber and sulfur plant 16 to produce additional elemental sulfur.

Elemental sulfur from sulfur plant 16 is then combined with asphalt in vessel 46 to produce sulfur-enriched asphalt.

The amount of sulfur blended into the asphalt will depend on the amount of sulfur and asphalt available, the desired properties of the enriched asphalt, and other considerations. For road building purposes, the amount of sulfur can be as much as 50 or more percent by weight of the blend.

Thus, the present invention enables production of low sulfur gas, liquid and coke from very high sulfur feedstocks, and at the same time provides a ready outlet for the large amount of by-product sulfur produced.

EXAMPLE

This Example illustrates a preferred embodiment of the process of the invention for a feedstock having the following properties:

| | |
|---|---|
| Gravity | −2° API |
| Sulfur | 9.6 Percent by Weight |
| Conradson Carbon | 25 Percent by Weight |
| Viscosity @ 210° F. | 10,500 centipoise |
| Initial Boiling Point | 500° F. |
| 15 Percent Distillation Point | 775° F. |
| 34 Percent Distillation Point | 1025° F. |

The feedstock is subjected to atmospheric distillation where it is separated into gas, naphtha having an upper boiling point of 400° F., distillate having a boiling range of 400° to 550° F., atmospheric gas oil having a boiling range of 550° to 650° F., and a 650° F.+ atmospheric resid. The atmospheric resid is subjected to further distillation under vacuum, producing a vacuum gas oil having a boiling range of 650° to 950° F. and a 950° F.+ vacuum resid.

The liquids, except for the vacuum resid, are desulfurized by conventional catalytic treatment in the presence of high pressure hydrogen.

The vacuum resid is split, with 56 parts going to a delayed coker and 10 parts going to an air blowing step to tailor the asphalt properties.

Green coke from the delayed coker is calcined at 2850° F. to produce calcined coke having a sulfur content of 1.5 percent by weight.

Sulfur from the desulfurization and sulfur conversion steps is added to the asphalt to produce a road paving material containing 51 percent by weight sulfur.

The product distribution and the sulfur content of the various product streams are as follows:

| Product | Sulfur - Percent by Weight |
|---|---|
| Gas | 0 |
| Naphtha | 0.003 |
| Distillate | 0.04 |
| Gas Oils | 0.5 |
| Coke | 1.5 |
| Asphalt | 51.1 |

Thus, useful products are produced from a feedstock which is not readily treated by conventional refining techniques, and the bulk of the internally produced sulfur is utilized directly in one of the product streams.

The foregoing description is intended to be illustrative rather than limiting of the invention. It will be apparent that numerous variations and modifications to the process as described could be utilized without departing from the invention, which is defined by the appended claims.

I claim:

1. A process for treating a heavy, high-sulfur crude oil to produce gas and liquid hydrocarbons, delayed petroleum coke and sulfur-enriched residuum comprising:

(a) subjecting said crude oil to distillation whereby gas and liquid hydrocarbon products and a residuum are produced;

(b) subjecting a first portion of said residuum to delayed coking;

(c) calcining the delayed coke to produce sulfur and calcined coke;

(d) recovering sulfur from said calcining step and adding said sulfur to a second portion of said residuum to produce a sulfur-enriched residuum.

2. The process of claim 1 wherein said second portion of residuum is air blown prior to addition of sulfur thereto, thereby producing a sulfur-enriched asphalt product.

3. The process of claim 2 wherein said distillation includes an atmospheric pressure distillation step and wherein the bottoms from said step are subjected to a vacuum distillation step to produce a vacuum residuum which is partially delayed coked and partially air blown to produce asphalt.

4. The process of claim 3 wherein said gas and liquid hydrocarbon products from said distillation are desulfurized.

5. The process of claim 4 wherein a distillate stream from said distillation is added to said asphalt.

6. The process of claim 5 wherein said crude oil contains more than 5 percent by weight sulfur.

* * * * *